US010010889B1

(12) United States Patent
Fortsch et al.

(10) Patent No.: US 10,010,889 B1
(45) Date of Patent: Jul. 3, 2018

(54) VERTICAL ROLLER MILL

(71) Applicant: FLSmidth A/S, Valby (DK)

(72) Inventors: David Fortsch, Easton, PA (US); Jason Euculano, Northampton, PA (US); William Wentzel, Bethlehem, PA (US); Kurt A. Geiger, Danielsville, PA (US)

(73) Assignee: FLSmidth A/S (DK)

( * ) Notice: Subject to any disclaimer, the term of this patent is extended or adjusted under 35 U.S.C. 154(b) by 0 days.

(21) Appl. No.: 15/575,436

(22) PCT Filed: May 31, 2016

(86) PCT No.: PCT/US2016/034999

§ 371 (c)(1),
(2) Date: Nov. 20, 2017

(87) PCT Pub. No.: WO2016/196456

PCT Pub. Date: Dec. 8, 2016

Related U.S. Application Data

(60) Provisional application No. 62/169,091, filed on Jun. 1, 2015.

(51) Int. Cl.
*B02C 15/00* (2006.01)
*B02C 23/26* (2006.01)
*B02C 23/30* (2006.01)

(52) U.S. Cl.
CPC ..... *B02C 15/001* (2013.01); *B02C 15/007* (2013.01); *B02C 23/26* (2013.01); *B02C 23/30* (2013.01); *B02C 2015/002* (2013.01)

(58) Field of Classification Search
CPC ..... B02C 15/001; B02C 15/005; B02C 2015/002; B02C 23/26; B02C 23/34; B02C 23/30
USPC ..... 241/57, 62, 119
See application file for complete search history.

(56) References Cited

U.S. PATENT DOCUMENTS 4,234,132 A * 11/1980 Maliszewski, Jr. ... B02C 15/001 241/119
4,264,041 A * 4/1981 Kitto, Jr. ..... B02C 15/001 241/103
4,541,574 A * 9/1985 Gygi ..... B02C 15/02 241/119
4,715,544 A 12/1987 Folsberg
4,721,258 A * 1/1988 Dougan ..... B02C 15/001 241/103
4,874,135 A * 10/1989 Provost ..... B02C 15/001 241/103

(Continued)

FOREIGN PATENT DOCUMENTS

GB 2193115 A 2/1988

OTHER PUBLICATIONS

International Search Report and Written Opinion dated Sep. 4, 2016, 5 pages.

*Primary Examiner* — Faye Francis
(74) *Attorney, Agent, or Firm* — Matthew R. Weaver; Daniel DeJoseph

(57) ABSTRACT

A vertical roller mill has grinding rollers which roll over a grinding path of a rotatable grinding table, and a surrounding nozzle ring separation area for conveying and separating gas. A coarse fraction of ground material is entrained in gas upwards in ducts from a location that is below, at, or above the nozzle ring separation area and is transported into an entry to a material separator located above the grinding table.

5 Claims, 5 Drawing Sheets

(56) References Cited

U.S. PATENT DOCUMENTS

| | | | | |
|---|---|---|---|---|
| 5,957,300 | A * | 9/1999 | Nardi | B02C 15/001 209/139.2 |
| 5,971,302 | A * | 10/1999 | Doumet | B02C 15/00 241/119 |
| 7,665,681 | B2 * | 2/2010 | Chen | B02C 15/02 241/119 |
| 8,113,452 | B2 * | 2/2012 | Folsberg | B02C 15/001 241/119 |
| 8,413,917 | B2 * | 4/2013 | Horning | B02C 15/001 241/119 |
| 8,528,844 | B2 * | 9/2013 | Horning | B02C 15/001 241/119 |
| 9,259,739 | B2 * | 2/2016 | Aizawa | B02C 15/007 |
| 2006/0049288 | A1 * | 3/2006 | Kronz | B02C 15/00 241/19 |
| 2011/0127360 | A1 | 6/2011 | Horning | |
| 2012/0085849 | A1 * | 4/2012 | Knope | B02C 15/001 241/101.2 |
| 2015/0053800 | A1 | 2/2015 | Vicat | |
| 2015/0246357 | A1 * | 9/2015 | Mersmann | B02C 15/04 241/18 |

* cited by examiner

VERTICAL ROLLER MILL

The invention relates in general to a vertical roller mill of the type comprising a grinding table which is rotatable about a vertical axis; at least two grinding rollers which are rotatable about substantially horizontal axes, and are directed against an annular grinding path of the grinding table; a nozzle ring separation area encircling the table for introducing separating, conveying, and possibly drying, gas into a mill housing above the grinding table; a separator located in the upper area of the mill to separate the material entrained by the conveying gas into a coarse fraction which is returned to the grinding table for renewed grinding and a fine fraction of finish ground material which is conveyed for further treatment or storage.

BACKGROUND OF THE INVENTION

In such mills material ground on the grinding table moves outward under centrifugal force, owing to the rotation of the grinding table, over the nozzle ring separation area, where the material undergoes nozzle ring separation. Material is both pneumatically conveyed upwards and inwards to the area above the grinding table by the gas stream from the nozzle ring separation area or falls through the nozzle ring separation areas to either a process by which the material is re-introduced to the mill or is removed from the process. This gas stream is employed for cooling, heating or drying the material inside the mill and transporting said material to the separator. The gas distribution and velocity through the nozzle ring separation area can be optimally adjusted to suit the specifics of the material. Finer particle fractions of ground material are suspended in the conveying gas and carried upwards inside the mill housing into the separator, while coarser particle fractions, too heavy to remain suspended in the conveying gas, fall down indiscriminately to various areas of the mill table, grinding track, outer mill housing and nozzle ring separation area whereupon material repeats the process of nozzle ring separation. Material can be subject to such repeated lift and fall cycles before reaching the separator and in this way a substantial amount of material can be conveyed randomly above the grinding table without landing on its grinding path for renewed grinding, which reduces the mill efficiency and particularly causes increased and unnecessary energy consumption. It is the object of the invention to overcome these mill inefficiencies.

SUMMARY OF THE INVENTION

In accordance with the invention, in a vertical roller mill of the kind described, gas passing through the nozzle ring separation area is directed into a plurality of gas ducts and thereafter is directed to the separator. There is an opening on the side of each duct, near the level of the table, facing the center of the table into which material is directed. The material entering the opening is pneumatically separated whereby material with suitable physical properties is entrained in the gas stream passing through the nozzle ring separation area. Any material not entrained in the gas coming up through the nozzle ring separation area will fall downward through the gas stream and is either mechanically returned to the table for further grinding or removed from process. In effect, the gas duct acts as a material splitter to separate predetermined coarse fractions of material from finer ground material.

For mills having a circular base and rollers distributed around the table, as shown in FIG. 1, for example, there preferably will be at least as many ducts in the mill as there are as rollers. However, for mills with other configurations, there may be fewer ducts than rollers. In most cases, a mill on which the present invention may be employed will have at least two rollers and at least two ducts.

The ducts are located on the outer perimeter of the table either inside, outside or integral to the mill housing and have a gas and material entry location that begins below, at, or above the table. Thus, material will exit the table, be directed to gas ducts and then be subject to the splitting function referenced above. Material of suitable physical properties will be entrained in gas that will pass upwards through the ducts to the separator thus eliminating repeated grinding cycles. There is therefore achieved a reduced power consumption for the conveying gas flow inside the mill housing.

DESCRIPTION OF THE DRAWINGS

The invention is now described in more detail by the way of an example of a mill according to the invention and with reference to the accompanying drawings, in which.

DESCRIPTION OF THE INVENTION

Figure 1:
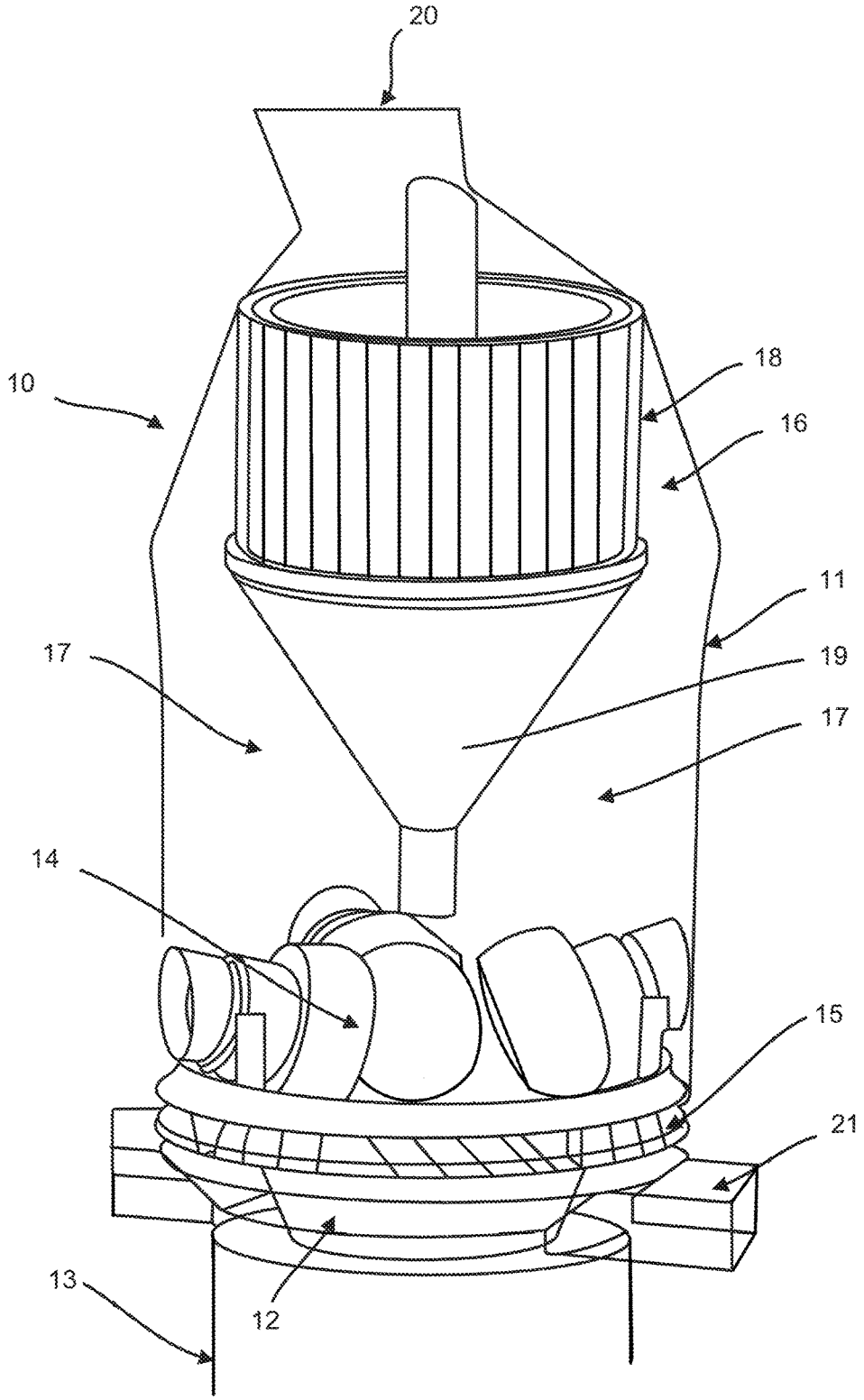
FIG. 1 is a diagrammatical elevation of a prior art vertical roller mill partly in a cut away, vertical section.

The prior art vertical roller mill 10 is completely enclosed within a vertical mill body 11, which serves to encapsulate gas, material, and grinding/separator parts. Mill 10 has a grinding table 12 rotating about a vertical axis supported and rotated by a gearbox 13 which is driven by a conventional motor (not shown). Other table support and drive configurations also exist and may be used with this invention. Pressing and rolling on the grinding table 12 are grinding rollers 14, in this example four grinding rollers, for grinding a material layer on the grinding table. Any number for roller s can be utilized. The vertical roller mill 10, has grinding rollers which are pressed against the grinding table 12 by hydraulic means (not shown). Other vertical roller mill configurations may have different loading mechanisms to press rollers against table. A nozzle ring separation area 15 encircles the grinding table, utilizing gas from the underlying gas inlet duct or ducts 21 which direct gas into a chamber located below the grinding table and thereafter through the nozzle ring separation area.

Above the grinding table 12 there is a separator 16, which may be dynamic or static. Ground material, moving upward through the open space 17, will enter the separator at an entry point that extend circumferentially around the separator at a lower point on its outer perimeter 18, with the entry to the separator being completely accessible to gas from the mill's interior. At the bottom of the separator is reject cone 19 for directing coarse material from the separator back to the grinding table. Gas with entrained fine material, i.e. material sufficiently ground in the mill, is pneumatically conveyed from the mill through an outlet duct 20 at the top of the separator 16.

Figure 2:
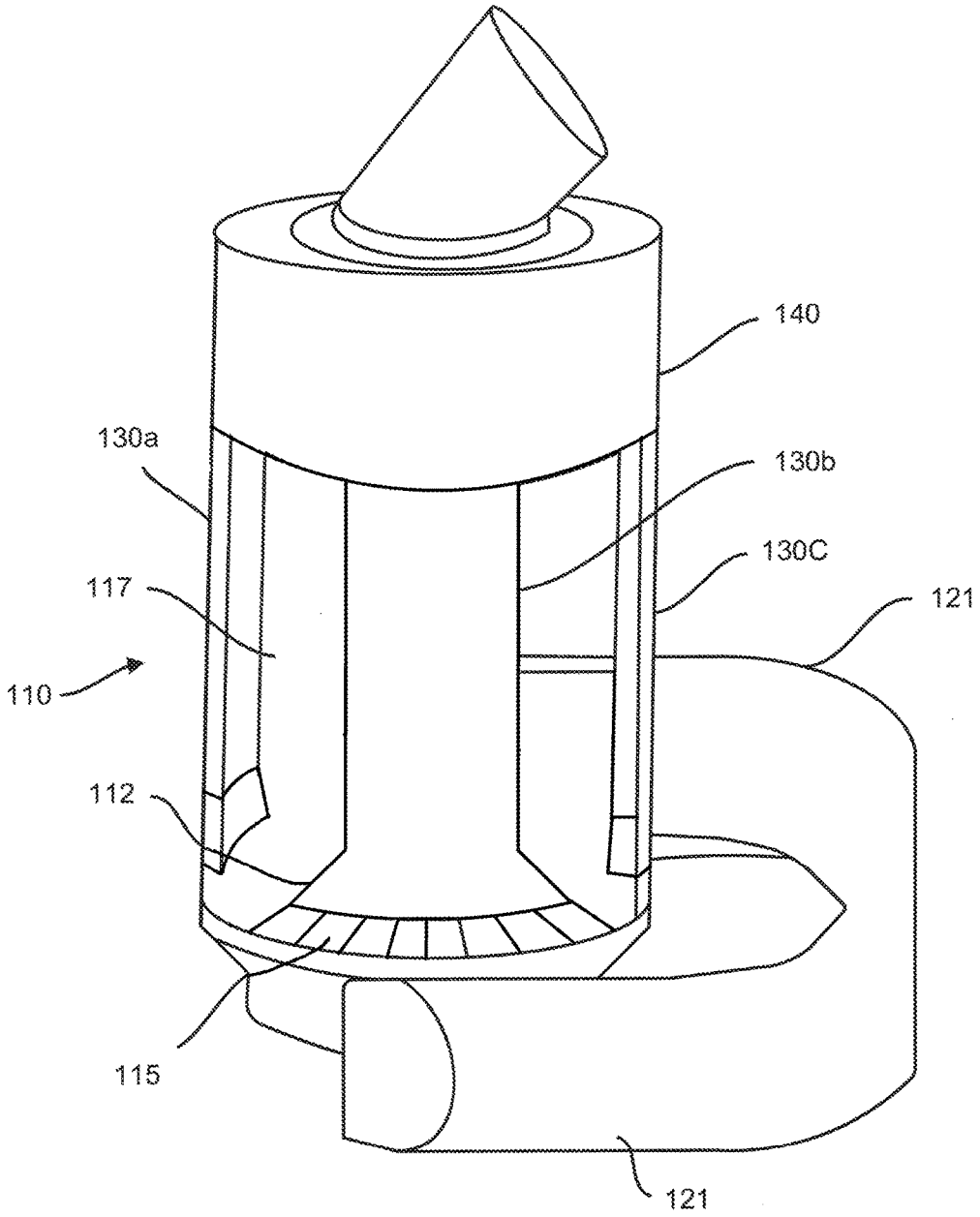
FIG. 2 illustrates the ducts utilized in the present invention.

FIG. 2 illustrates certain aspects of the gas distribution system of the mill 110 of the present invention. In order to facilitate the view, certain internal elements of the mill, such as the rollers and reject cone, have been omitted from this particular view. In addition, the outer mill body is omitted from this view.

Gas inlet duct 121 directs gas to nozzle ring separation area 115, which is configured for the interaction of gas with the material coming off of table 112. Gas ducts or channels 130 are located at the outer perimeter of table 112. Gas ducts 130 are in flow connection with nozzle ring separation area 115, by which it is meant that gas flowing into the nozzle ring separation area 115 will thereafter be directed to the ducts 130. The entrance of gas into duct 130 can therefore be located below, at or above the nozzle ring separation area 115. The nozzle ring separation area may consist of various configurations of blades, no blades, oriented in various angles. The ducts are referenced individually as ducts 130*a*, 130*b* and 130*c*. Multiple ducts at each location may occur. Due to the perspective of the drawing, a fourth duct (not shown) is located behind duct 130*b* on the opposite side of table 112. The ducts 130 serve to convey gas, and any entrained matter, to the separator, which is encased within separator housing 140. As a result of housing 140 and appropriate seals, the separator is sealed off from any gas and material flow not contained in ducts 130. That is, any material located in open area 117 in the interior of the mill cannot enter the separator other than via ducts 130. Functionally the separator utilized in the vertical roller mill of the present invention is not changed from what is used in prior art mills, and therefore may be dynamic or static, with a reject cone to direct coarse material back to the table. The primary difference is that the separator has seals against flow from the interior of the mill, and is thereby adapted to receive gas and material only from the channels. The reject coarse may be fitted with an air sluice at the discharge to reduce any back flow to the separator.

Figure 3:
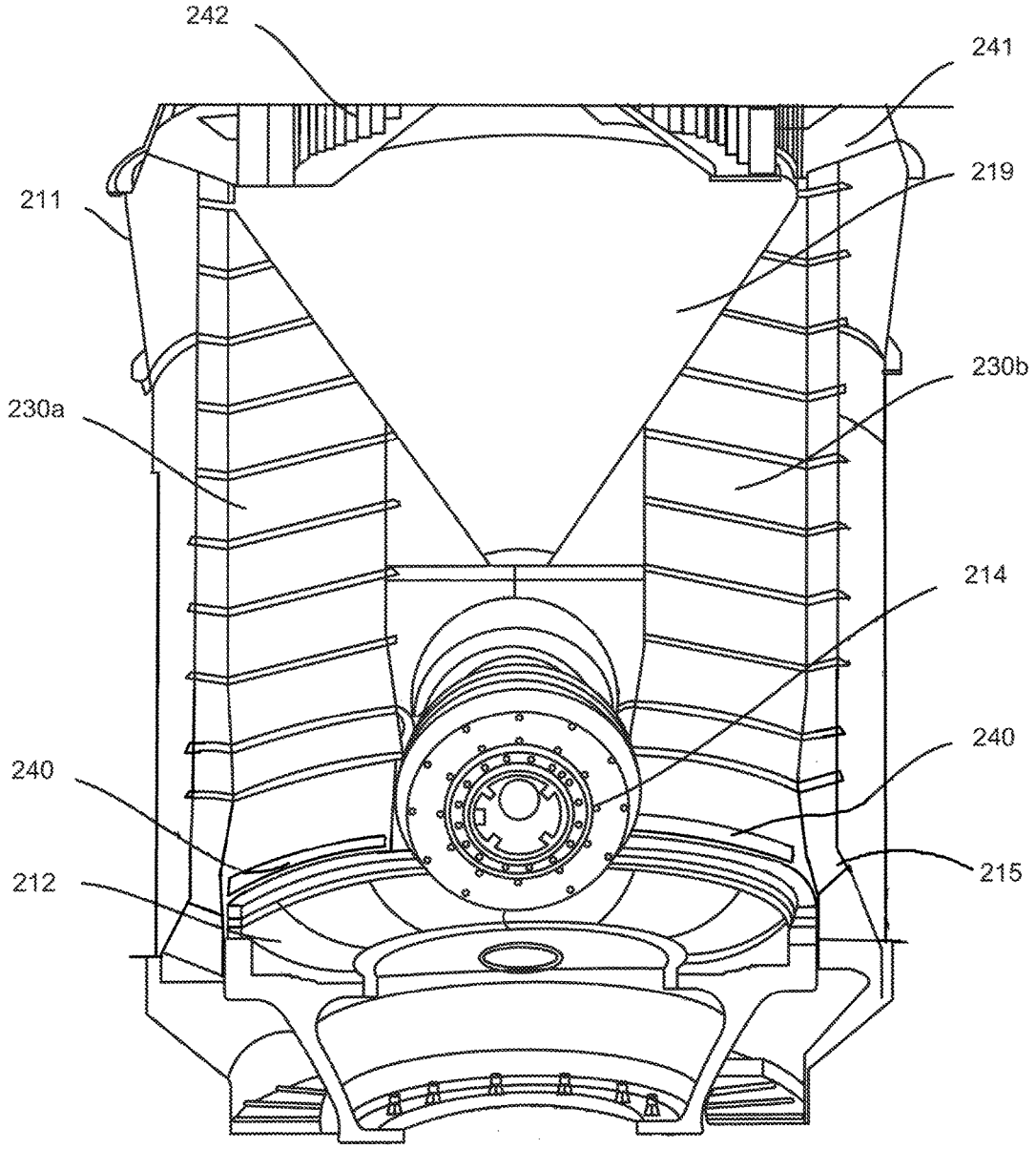
FIG. 3 is an interior view of the mill of the present invention.
Figure 4:
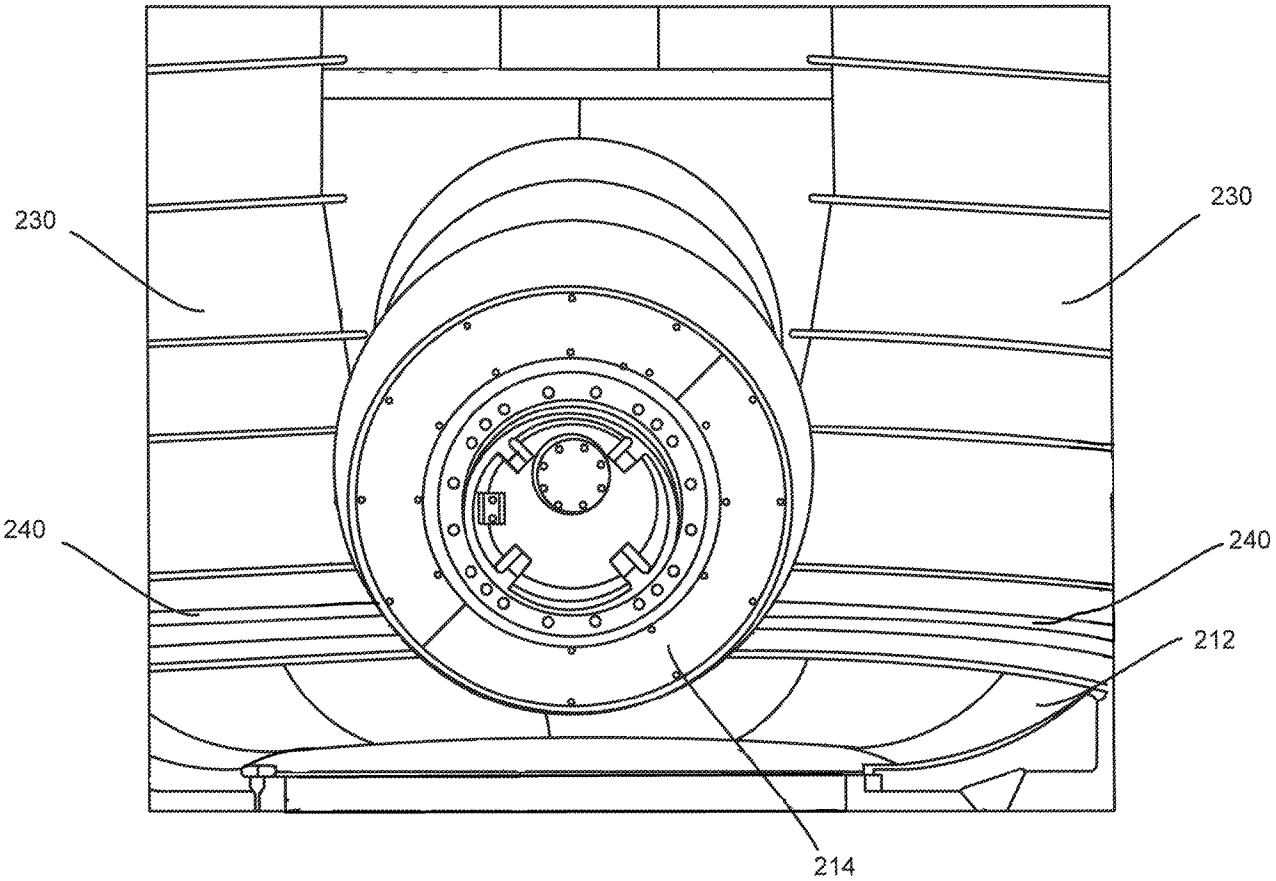
FIG. 4 is a detail view of the vicinity near the grinding roller depicted in FIG. 3.

With reference to FIG. 3, there is depicted a portion of the interior of a vertical roller mill of the present invention, with only one grinding roller 214 being depicted. Ducts 230*a* and 230*b* are located on either side of grinding roller 214 and have a lower gas entrance below, at or above nozzle ring separation area 215. There is depicted a slot 240 on the bottom of an interior side of each duct which faces table 212 and which will receive material from table 212. There is an adjustable inlet gate attached to the slot 240 to optimize material flow characteristics to slot 240. Conveying gas is directed into nozzle ring separation area 215 and entrains the material entering slot 240. Gas with entrained material moves up through duct 230 to separator inlet 241, which is sealed from any mill body gas except through the ducts and from a possible back flow from reject cone 219, the latter may be prevented through the use of a reject cone air sluice (not shown). The guide vane arrangement 242 leading to the interior of the separator can be configured to allow for pre-separation and rejection of material with unsuitable physical properties, with said rejected material being directed into reject cone 219.

Optionally ducts 230 can be configured to be inside, outside or integral to the mill body 211.

Figure 5:
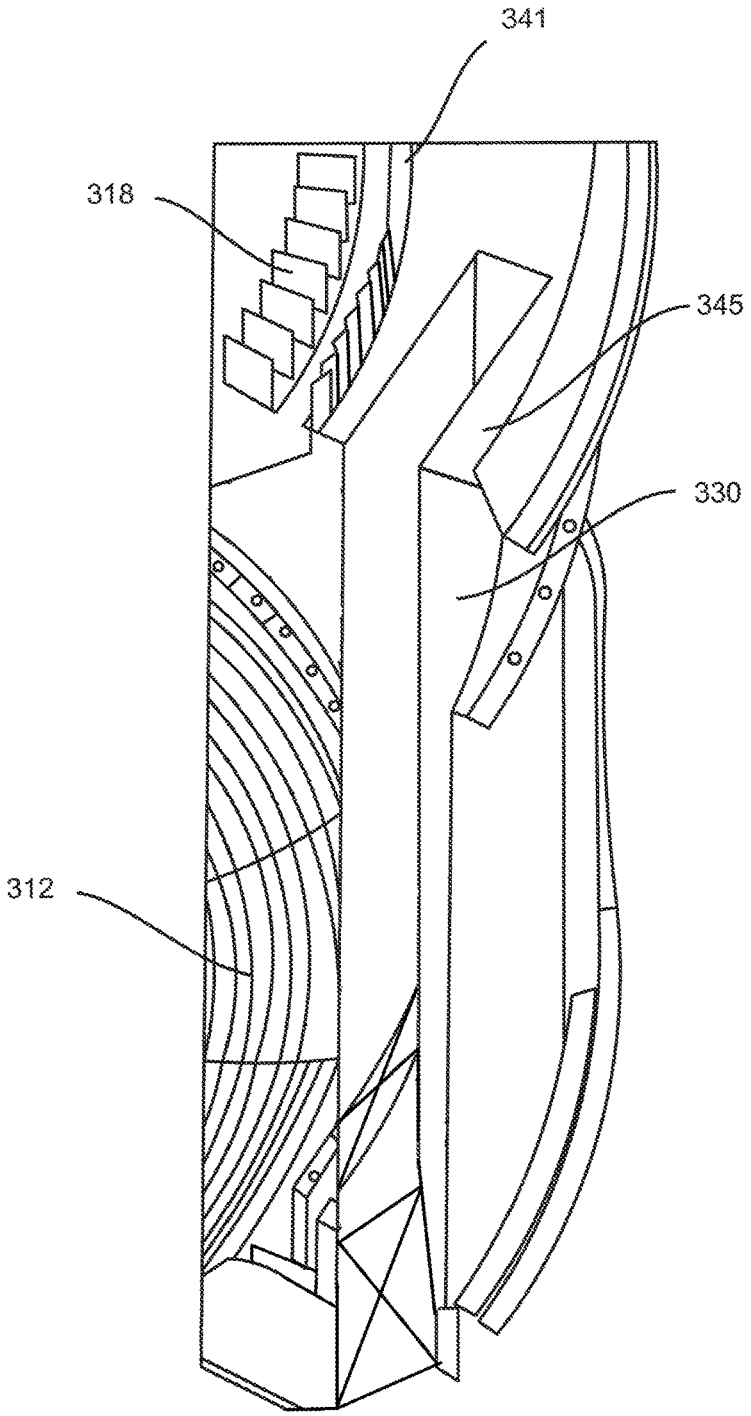
FIG. 5 show various views of the ducts utilized in the vertical mill of the present invention.

With reference to FIG. 5, depicted is duct 330 which extend vertically from a lower end located adjacent to table 312 to an upper end discharging gas and material in inlet 341 of separator 318. There is a seal 345 at the separator inlet 341 which prevents gas from any location other than the upper end of duct 330 from entering the separator 318.

The duct can be of any cross section which allows for suitable flow characteristics. While a rectangular duct is depicted, but it can be circular, oval, etc.

We claim:

1. A vertical roller mill comprising:

a grinding table having an outer perimeter, the grinding table being rotatable about a vertical axis;

at least two grinding rollers for grinding material located on the grinding table, the at least two grinding rollers being rotatable about substantially horizontal axes and being forced against an annular grinding path of the grinding table;

a nozzle ring separation area encircling the grinding table for introducing separating and conveying gas toward a material separator having an entry for gas and entrained ground material, the material separator located above the grinding table;

and at least two ducts for gas and ground material, the at least two ducts being situated adjacent to the grinding table, each of the at least two ducts having a lower gas entry end flow connected to the nozzle ring separation area through which gas passes into the at least two ducts and an upper end adjacent to the entry into material separator through which gas passes into the material separator, each of the at least two ducts further having a material entry point that faces the grinding table into which ground material is directed while the grinding table is rotating to thereafter be entrained within at least two ducts in gas from the nozzle ring separation area.

2. A vertical roller mill according to claim 1, wherein the material separator is sealed so that only material and gas exiting the at least two ducts can enter the material separator.

3. A vertical roller mill according to claim 1, wherein the vertical roller mill contains more than two of the at least two ducts conveying material and gas to the material separator.

4. A vertical roller mill according to claim 1, wherein the at least two ducts have a cross section which allows for suitable flow characteristics in the at least two ducts.

5. A vertical roller mill according to claim 1, wherein the material separator is sealed off from receiving any gas and material flow form a source other than the at least two ducts.

* * * * *